US011498345B2

(12) United States Patent
Shinoda

(10) Patent No.: US 11,498,345 B2
(45) Date of Patent: Nov. 15, 2022

(54) CUTTER UNIT INCLUDING FIXED BLADE AND MOVABLE BLADE TO CUT ITEM IN COOPERATION WITH EACH OTHER

(71) Applicant: BROTHER KOGYO KABUSHIKI KAISHA, Nagoya (JP)

(72) Inventor: Mayu Shinoda, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 183 days.

(21) Appl. No.: 16/941,010

(22) Filed: Jul. 28, 2020

(65) Prior Publication Data

US 2021/0031543 A1 Feb. 4, 2021

(30) Foreign Application Priority Data

Jul. 30, 2019 (JP) ..... JP2019-139921
Mar. 31, 2020 (JP) ..... JP2020-062340

(51) Int. Cl.

| | |
|---|---|
| ***B41J 11/70*** | (2006.01) |
| ***B65H 35/00*** | (2006.01) |
| ***B41J 3/407*** | (2006.01) |
| ***B41J 15/04*** | (2006.01) |
| ***B65H 20/02*** | (2006.01) |
| ***B26D 1/02*** | (2006.01) |

(Continued)

(52) U.S. Cl.

CPC ..... *B41J 11/703* (2013.01); *B26D 1/025* (2013.01); *B26D 1/065* (2013.01); *B41J 3/4075* (2013.01); *B41J 11/70* (2013.01); *B41J 15/046* (2013.01); *B65H 20/02* (2013.01); *B65H 35/0086* (2013.01); *B26D 2001/0066* (2013.01); *B26D 2007/005* (2013.01); *B41J 15/042* (2013.01)

(58) Field of Classification Search

CPC ..... B41J 11/703; B41J 3/4075; B41J 11/70; B41J 15/046; B41J 15/042; B65H 20/02; B65H 35/0086; B26D 2001/0066; B26D 2007/005; B26D 1/025; B26D 1/065

See application file for complete search history.

(56) References Cited

U.S. PATENT DOCUMENTS 6,405,625 B1 * 6/2002 Nomura ..... B26D 3/12 83/636
9,969,190 B2 * 5/2018 Nomura ..... B41J 11/70

(Continued)

FOREIGN PATENT DOCUMENTS

JP 2008-068565 A 3/2008

*Primary Examiner* — Yaovi M Ameh
(74) *Attorney, Agent, or Firm* — Kenealy Vaidya LLP

(57) ABSTRACT

A cutter unit includes a first frame, a fixed blade, a movable blade, a movable blade drive mechanism and a pressure mechanism. The fixed blade has a first cutting edge portion. One end portion of the movable blade has one end configured to cut a cut item in cooperation with the first cutting edge portion. The second cutting edge portion and the first cutting edge portion contacting with each other at a first point and a second point. Another end portion of the movable blade has a contacting portion in contact with the first frame at a third point. The first point, the second point and the third point define an imaginary triangle. The pressure member presses the movable blade at a pressure contact position so that the movable blade presses against the fixed blade. The pressure contact position is positioned substantially within the imaginary triangle.

8 Claims, 16 Drawing Sheets

(51) Int. Cl.

| | |
|---|---|
| ***B26D 1/06*** | (2006.01) |
| *B26D 7/00* | (2006.01) |
| *B26D 1/00* | (2006.01) |

(56) References Cited

U.S. PATENT DOCUMENTS

| | | | | |
|---|---|---|---|---|
| 2008/0069623 | A1* | 3/2008 | Kobayashi | B26D 1/085<br>400/621.1 |
| 2010/0086340 | A1* | 4/2010 | Takami | B41J 3/4075<br>400/621 |

* cited by examiner

CUTTER UNIT INCLUDING FIXED BLADE AND MOVABLE BLADE TO CUT ITEM IN COOPERATION WITH EACH OTHER

CROSS REFERENCE TO RELATED APPLICATION

This application claims priority from Japanese Patent Application Nos. 2019-139921 filed Jul. 30, 2019 and 2020-062340 Mar. 31, 2020. The entire contents of the priority applications are incorporated herein by reference.

TECHNICAL FIELD

The present disclosure relates to a cutter unit and a printer including the cutter unit.

BACKGROUND

United States Patent Application Publication No. 2008/0069623 A1 discloses a printer including a cutter unit for cutting a sheet paid out from a sheet roll. The cutter unit includes a rear frame, a movable blade, a fixed blade, and a pressure spring. The rear frame supports the movable blade movable in upward/downward direction. The fixed blade has a lower end formed with a linear cutting edge. The movable blade has an upper end formed with a cutting edge extending in NT-shape. In accordance with upward movement of the movable blade, the cutting edge of the movable blade and the cutting edge of the fixed blade nip the sheet therebetween.

The movable blade includes a guide portion extending downward. The pressure spring presses against the movable blade in a direction toward the rear frame and the fixed blade. The cutting edge of the movable blade contacts the cutting edge of the fixed blade at two points. Further, a left end and a right end of a lower portion of the guide portion contact the rear frame. Therefore, the movable blade presses against the fixed blade and the rear frame at totally four contacting points.

SUMMARY

However, pressing force of the pressure spring applied to two points between the fixed blade and the movable blade may be out of balance due to insufficient dimensional accuracy of the parts and components constituting the cutter unit and insufficient assembling accuracy of the components. In such a case, wrong cut may occur particularly for cutting a thin soft sheet.

In view of the foregoing, it is an object of the disclosure to provide a cutter unit capable of performing stabilized cutting with respect to a thin soft cut item which is unlikely to be cut in a conventional cutter unit.

In order to attain the above and other objects, the present disclosure provides a cutter unit including a first frame, a fixed blade, a movable blade, a movable blade drive mechanism and a pressure mechanism. The fixed blade is fixed to the first frame and has a flat plate shape. The fixed blade has a first cutting edge portion extending linearly. The movable blade is movable in a moving direction. The movable blade has a flat plate shape. The movable blade has one end portion and another end portion in the moving direction. The one end portion has one end in the moving direction formed with a second cutting edge portion having V-shape and configured to cut a cut item in cooperation with the first cutting edge portion. The second cutting edge portion and the first cutting edge portion contacting with each other at a first point and a second point. The another end portion has a contacting portion in contact with the first frame at a third point. The first point, the second point and the third point define an imaginary triangle such that each of the first point, the second point and the third point is an apex of the imaginary triangle. The movable blade drive mechanism is configured to move the movable blade in the moving direction. The pressure member presses the movable blade at a pressure contact position so that the movable blade presses against the fixed blade in a pressing direction crossing the moving direction and directs from the pressure member toward the fixed blade and the first frame. The pressure contact position is positioned substantially within the imaginary triangle.

According to the second aspect, the disclosure to provide a printer includes the above-described cutter unit, a printing unit and a conveying unit. The printing unit is configured to perform printing on a printing medium as the cut item. The conveying unit is configured to convey the printing medium on which an image is formed by the printing unit toward the cutter unit.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

Figure 1:
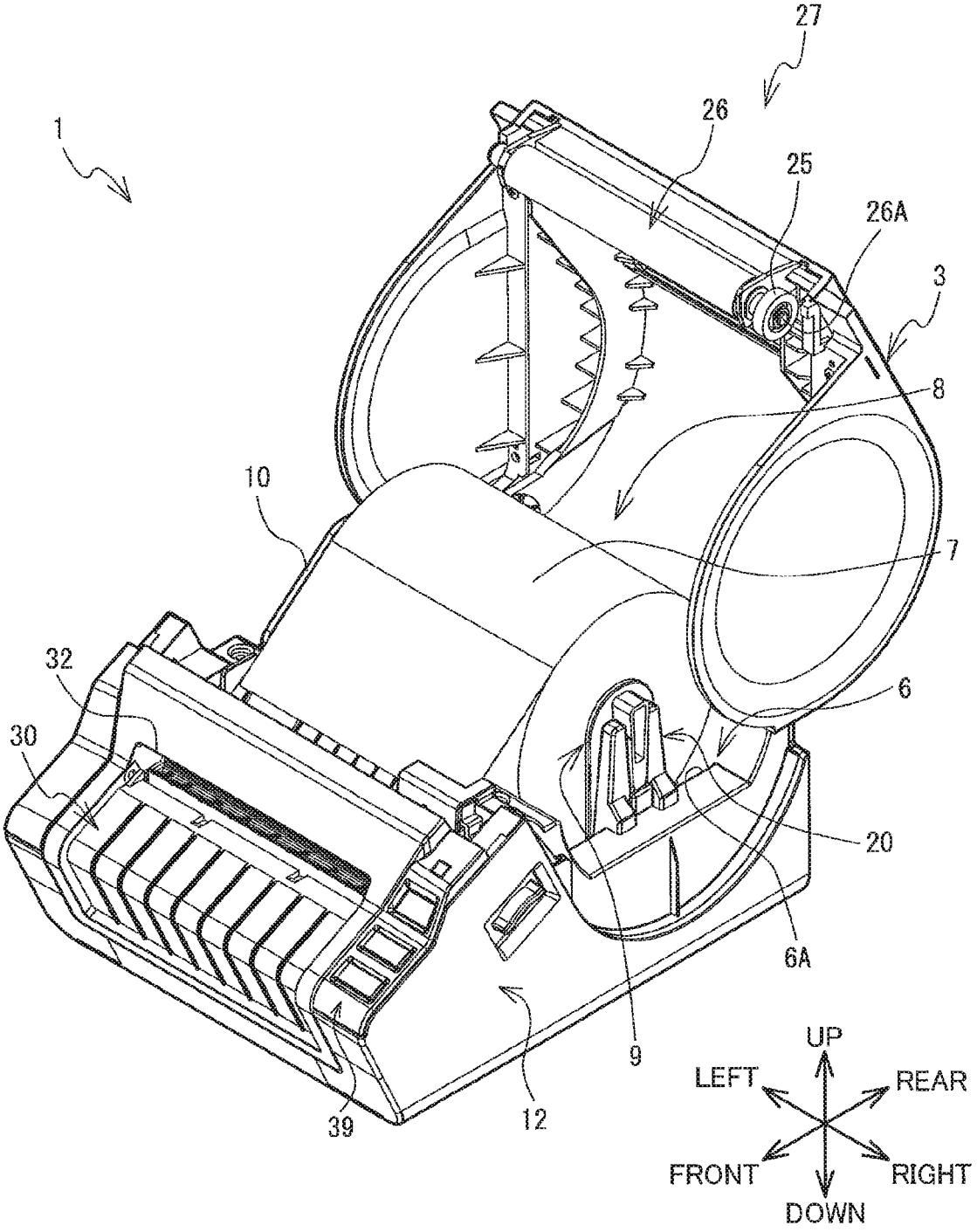
FIG. 1 is a perspective view of a printer according to one embodiment is provided.

Hereinafter, a printer 1 according to one embodiment of the present disclosure will be described, with reference to FIGS. 1 and 2. A roll 8 of a printing medium 7 is accommodated in the printer 1. The printing medium 7 is thin and flexible or soft sheet, such as for example a tape having a thickness of not more than 0.1 mm. In the printer 1, printing is performed on the printing medium 7 paid out from the roll 8, and thereafter, the printing medium 7 is cut as a cut item. In the drawings, "left side", "right side", "upper side" "lower side", "front side" and "rear side" are indicated by arrows. These directions are applicable to the printer 1.

The printer 1 includes a housing 12 having a box-like shape. The housing 12 has a rear internal portion recessed downward to form an accommodating portion 6. The accommodating portion 6 has an opening 6A for receiving the roll 8 in the accommodating portion 6. Further, a roll support portion 20 is provided in the accommodating portion 6.

The roll 8 includes a cylindrical core portion 4 and the printing medium 7 wound thereover. A right holder portion 9 and a left holder portion 10 are attached to the core portion 4. The right holder portion 9 and the left holder portion 10 attached to the core portion 4 are attachable to the roll support portion 20. The right holder portion 9 and the left holder portion 10 rotatably supports the core portion 4 by being attached to the support portion 20. Hence, the roll 8 is accommodated in the accommodating portion 6, and the core portion 4 is rotatable along with the printing medium 7.

A cover 3 for opening and closing the opening 6A is pivotally movably supported by a rear end portion of the housing 12. The cover 3 has a tip end portion rotatably supporting a platen roller 26 extending in leftward/rightward direction. The platen roller 26 includes a shaft portion 26A. The shaft portion 26 has a right end portion where a roller gear 25 is fixed.

A front cover 30 is attached to the housing 12 for covering a front side and upper side of a cutter unit 100 described later. The front cover 30 is formed with a discharge opening 32 for discharging the printing medium 7 therethrough. The discharge opening 32 has a rectangular shape elongated in leftward/rightward direction. An operating portion 39 is provided at a right upper end portion of the front cover 30 to allow a user to input various instruction through the operating portion 39.

A printing unit 21 is provided at a center portion in frontward/rearward direction of the housing 12. The printing unit 21 includes a head support portion 28 and a print head 29. The head support portion 28 is movable in upward/downward direction, and is urged upward by a spring 24. The print head 29 is mounted on an upper surface of the head support portion 28. The print head 29 is a thermal head including a plurality of heat generating elements (not illustrated).

A gear train (not illustrated) and a conveyer motor (not illustrated) are provided inside the housing 10. When the cover 3 is at a closed position closing the accommodating portion 6, the platen roller 26 urges the print head 29 downward against the urging force of the spring 24. At this time, the roller gear 25 is brought into meshing engagement with the gear train (not illustrated), and is drivingly connected to the conveyer motor. In the following description, a combination of the platen roller 26, the roller gear 25, the gear train, and the conveyer motor will be referred to as a conveying unit 27.

A guide plate 23 is positioned frontward of the head support portion 28. The guide plate 23 has a horizontal portion extending in leftward/rightward direction and is configured to guide the printing medium 7 frontward. The cutter unit 100 is provided frontward of the guide plate 23.

Next, the cutter unit 100 will be described with reference to FIGS. 2 through 7. The cutter unit 100 is configured to cut the printing medium 7 as the cut item guided by the guide plate 23.

Figure 2:
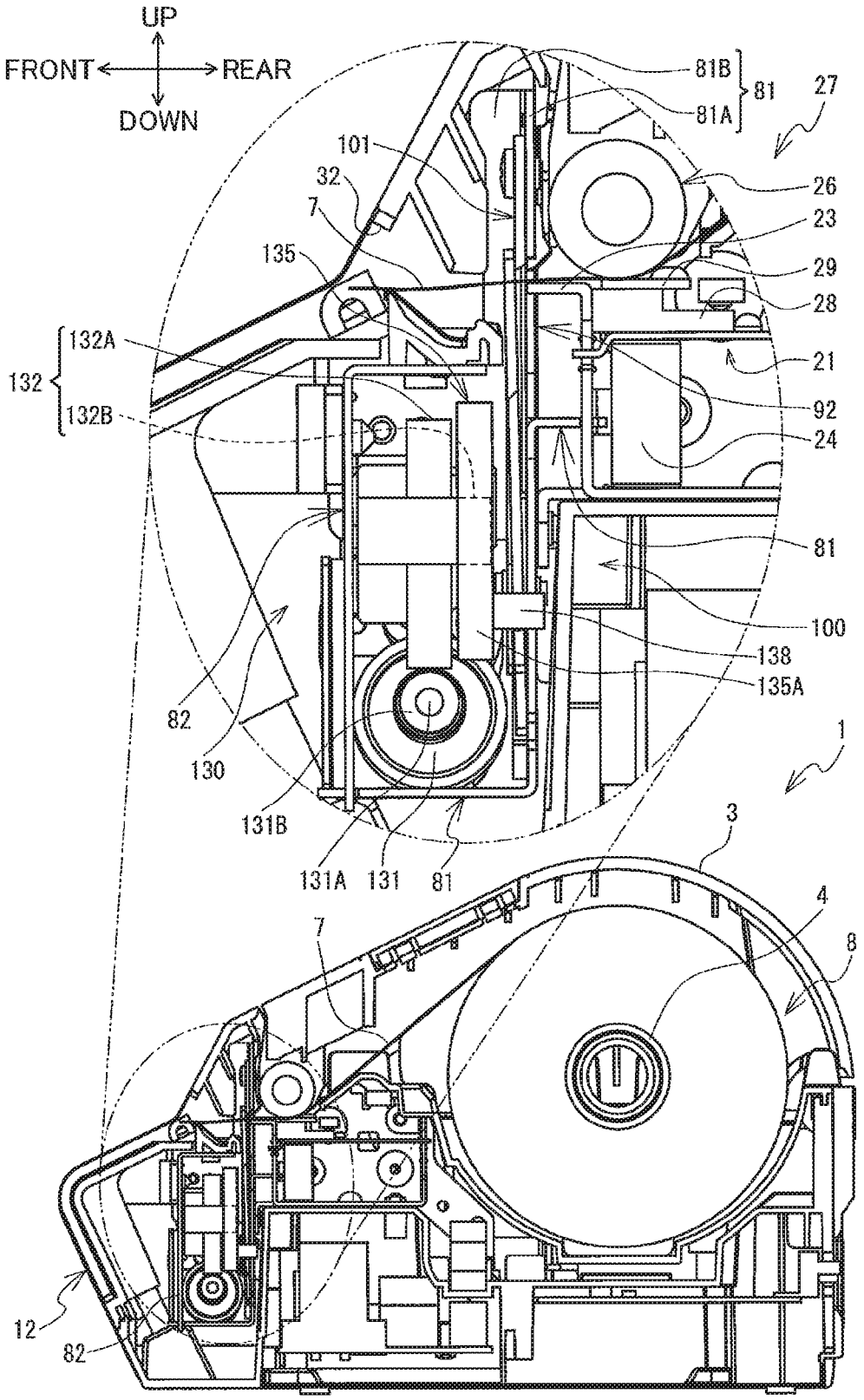
FIG. 2 is a right-side view illustrating an internal structure of the printer.
Figure 3:
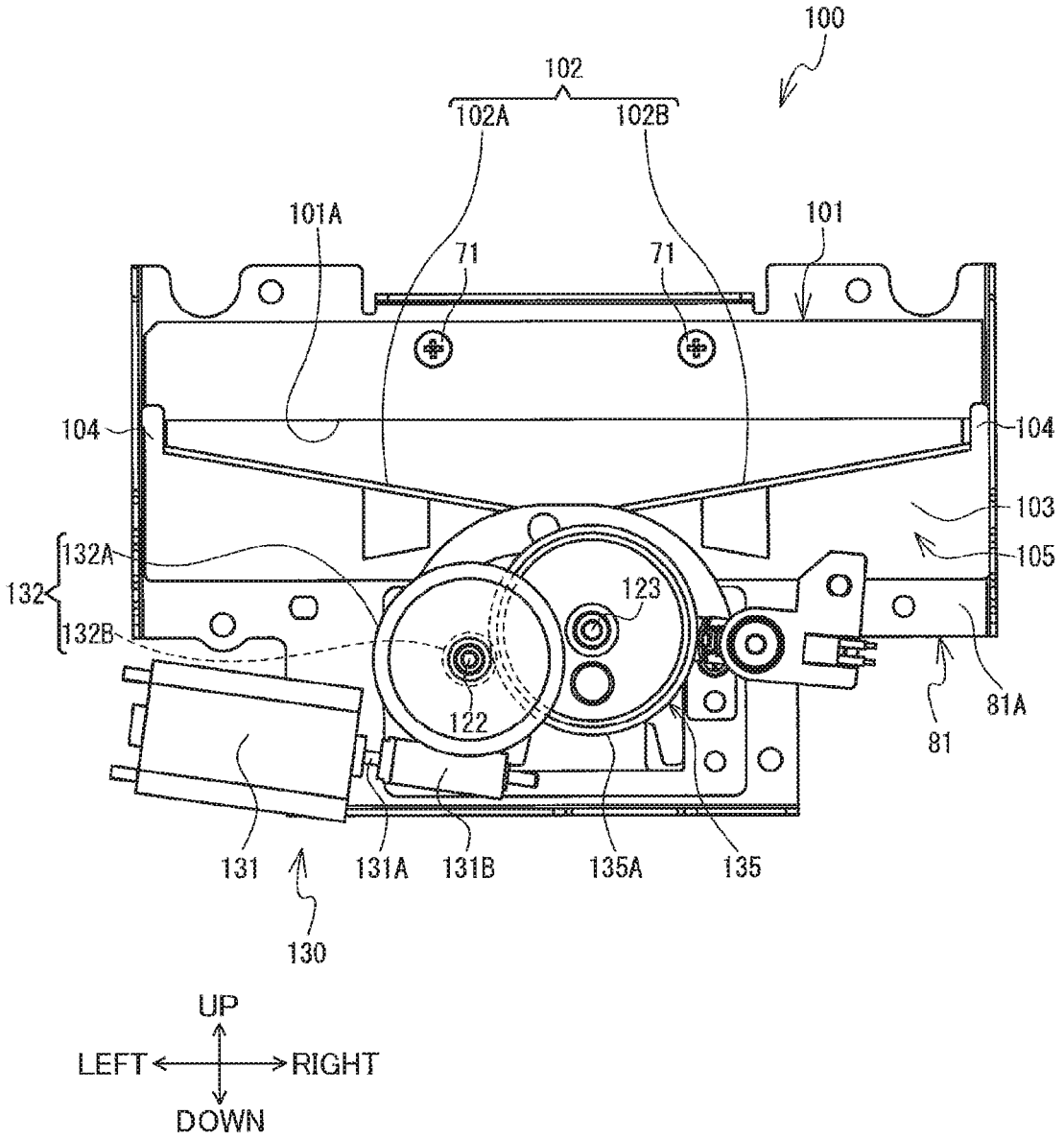
FIG. 3 is a front view illustrating a cuter unit 100 according to the embodiment.

As illustrated in FIGS. 2 and 3, the cutter unit 100 includes a first frame 81, a fixed blade 101, a movable blade 105, and a movable blade drive mechanism 130.

Figure 5:
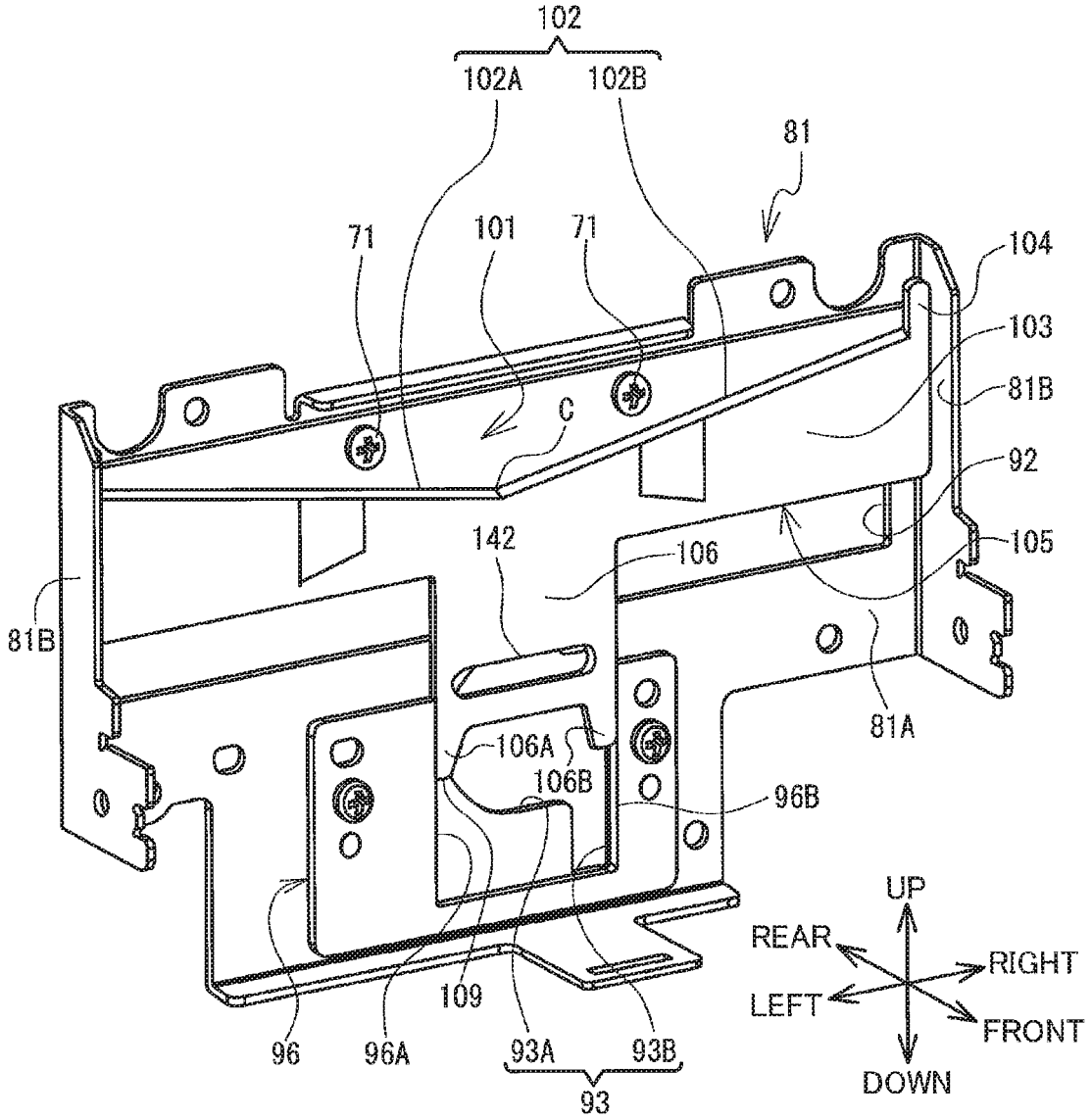
FIG. 5 is a perspective view illustrating a first frame 81, a fixed blade 101, and a movable blade 105 in the cutter unit.
Figure 6:
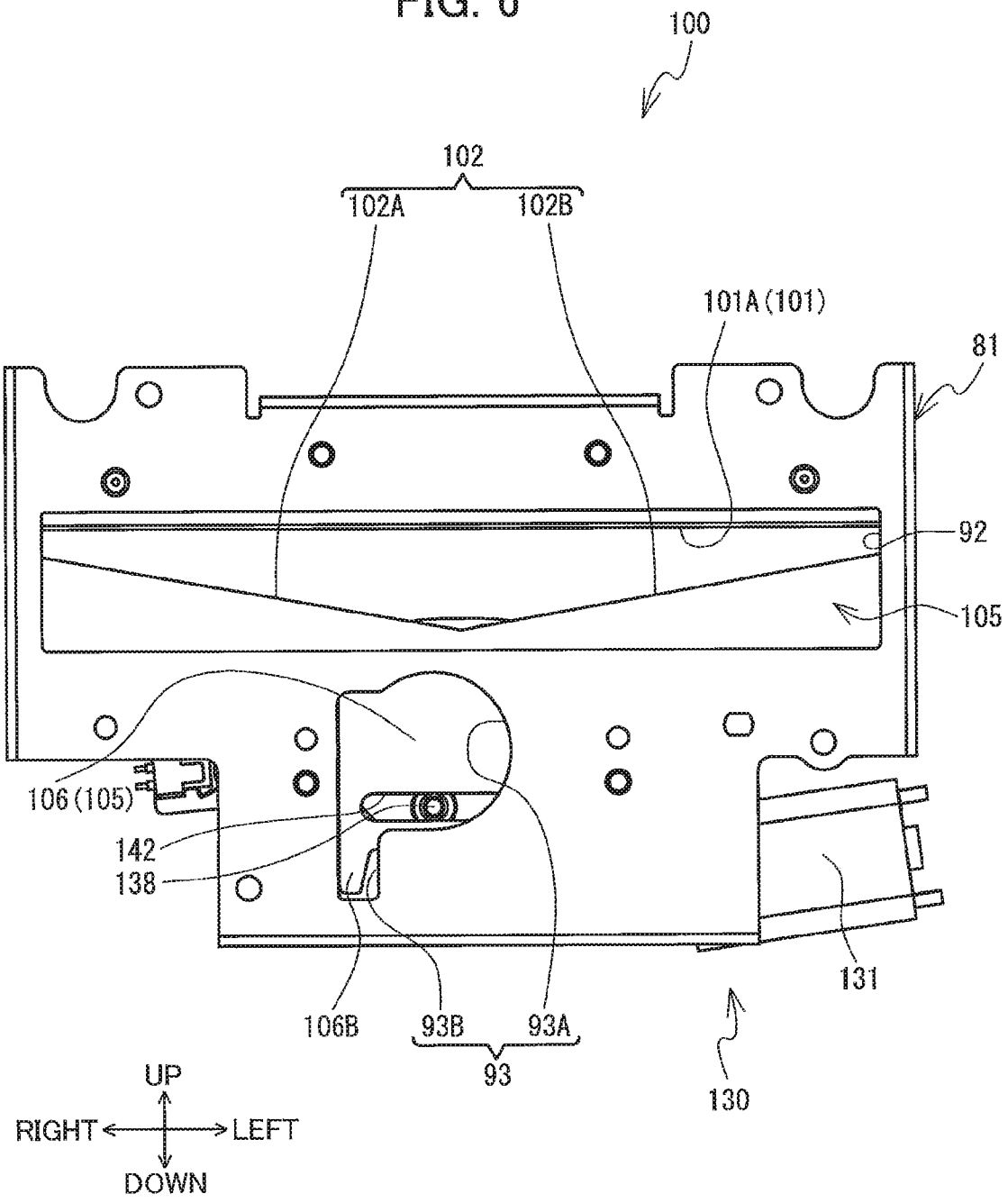
FIG. 6 is a rear view of the cutter unit.

The first frame 81 illustrated in FIGS. 5 and 6 is in a form of a metal plate fixed to a power portion of the housing 12. The first frame 81 includes a rectangular plate section 81A, and a pair of auxiliary guide sections 81B. The rectangular plate section 81A extends in leftward/rightward direction. Each auxiliary guide section 81B protrudes frontward from each end in leftward/rightward direction of the rectangular plate section 81A.

The rectangular plate section 81A has a center portion in upward/downward direction where a passage hole 92 is formed. The passage hole 92 has a rectangular shape elongated in leftward/rightward direction. As illustrated in FIG. 2, a front end portion of the guide plate 23 is positioned in the passage hole 92.

The rectangular plate section 81A has a lower end portion where a through-hole 93 is formed. As illustrated in FIG. 6, the through-hole 93 includes a circular hole 93A and a rectangular hole 93B connected to a right side of the circular hole 93A and extending in upward/downward direction.

An auxiliary plate 96 is fixed to a lower front surface of the rectangular plate section 81A. The auxiliary plate 96 has a U-shape in front view, and includes a guide portion 96A positioned leftward of the through-hole 93 and an auxiliary guide portion 96B positioned rightward of the through-hole 93. The guide portion 96A and the auxiliary guide portion 96B are positioned outside of the through-hole 93 in front view.

Figure 4:
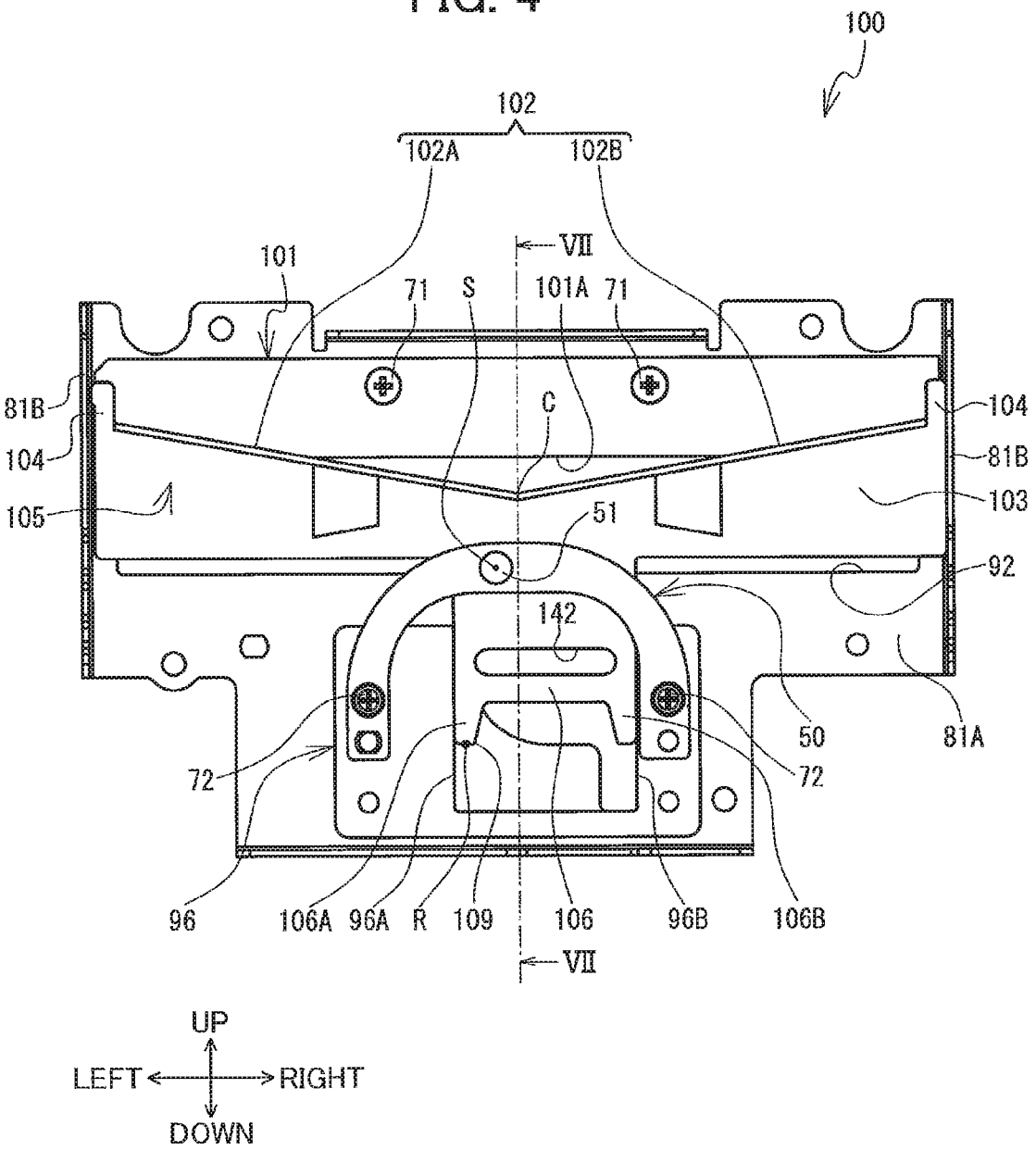
FIG. 4 is a front view of the cutter unit 100 omitting illustration of a movable blade drive mechanism 130.

As illustrated in FIGS. 3 and 4, the fixed blade 101 is flat plate shaped and has a thickness in frontward/rearward direction. The fixed blade 101 is fixed to the front surface of the rectangular plate section 81A by two male threads 71.

The fixed blade 101 has a lower end formed with a first cutting edge portion 101A extending linearly in leftward/rightward direction.

Figure 7:
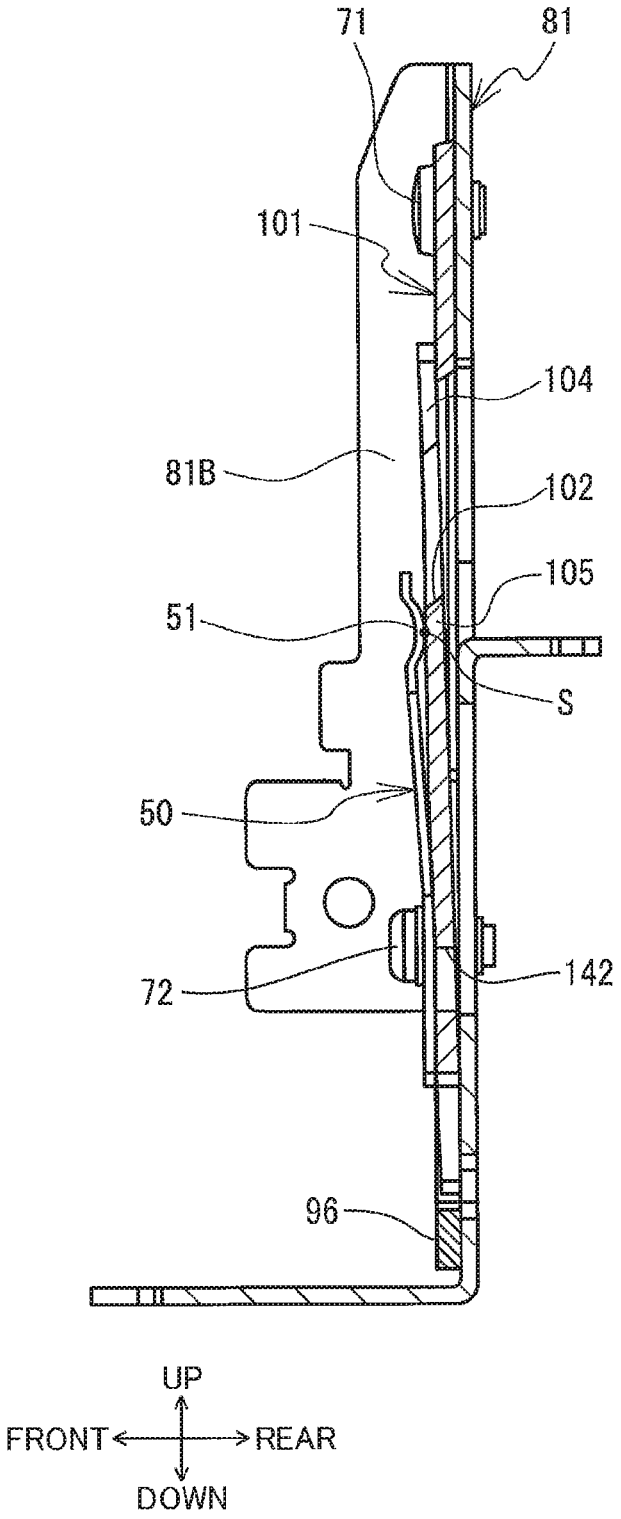
FIG. 7 is a cross-sectional view of the fixed blade 101 and the movable blade 105 taken along the line VII-VII in FIG. 4.

As illustrated in FIG. 5, the movable blade 105 is generally flat plate shaped and has a thickness in frontward/rearward direction. The movable blade 105 is movable in upward/downward direction relative to the first frame 81. The upward/downward direction is an example of "moving direction". The movable blade 105 is positioned frontward of the fixed blade 101 and the rectangular plate section 81A of the first frame 81. Hence, the direction from the movable blade 105 toward the fixed blade 101 and the rectangular plate section 81A is a rearward direction. The movable blade 105 is in contact with the first frame 81 and the fixed blade 101 and is supported by the first frame 81 and the fixed blade 101. Further, the movable blade 105 is inclined such that an upper end of the movable blade 105 is positioned slightly frontward of a lower end of the movable blade 105 as illustrated in FIG. 7 (forward tilting posture).

The movable blade 105 has an upper portion 103 whose rear surface is in contact with the fixed blade 101. The movable blade 105 includes a second cutting edge portion 102 and a pair of extension portions 104. The second cutting edge portion 102 is configured to nip the printing medium 7 in cooperation with the first cutting edge portion 101A, and is v-shaped in front view. Each extension portion 104 extends upward from each end in leftward/rightward direction of the second cutting edge portion 102. The pair of extension portions 104 are positioned between the pair of auxiliary guide sections 81B of the first frame 81 in leftward/rightward direction. Hence, the movement of the movable blade 105 in leftward/rightward direction is restricted by the pair of auxiliary guide sections 81B.

The second cutting edge portion 102 includes a first inclined cutting edge portion 102A and a second inclined cutting edge portion 102B bilaterally symmetric with each other. The first inclined cutting edge portion 102A and the second inclined cutting edge portion 102B are inclined diagonally downward toward a center C (FIG. 4) in leftward/rightward direction of the second cutting edge portion 102. Further, the second cutting edge portion 102 is bent such that the center C of the second cutting edge portion 102 is a rearmost end and the leftmost end and rightmost end of the second cutting edge portion 102 are frontmost ends (sec FIG. 9).

With such a configuration, the first inclined cutting edge portion 102A contacts the first cutting edge portion 101A of the fixed blade 101 at one point, and the second inclined cutting edge portion 102B contacts the first cutting edge portion 101A at one point. In the following description the contacting point between the first inclined cutting edge portion 102A and the first cutting edge portion 101A will be referred to as a first point P, and the contacting point between the second inclined cutting edge portion 102B and the first cutting edge portion 101A will be referred to as a second point Q (see FIG. 8). The first point P and the second point Q are cutting points at which the printing medium 7 is cut. The first point P and the second point Q move toward a center line CL extending in upward/downward direction and passing through the center C in accordance with upward movement of the movable blade 105.

The movable blade 105 includes a lower portion 106 having rectangular shape in front view, and extending downward from the upper portion 103. The lower portion 106 has a center in leftward/rightward direction displaced rightward from the center line CL. The lower portion 106 includes a first section 106A and a second section 106B. The first section 106A and the second section 106B are positioned side by side in leftward/rightward direction, and extend downward from a left lower end and a right lower end of the lower portion 106, respectively, and have generally rectangular shape.

The first section 106A is in contact with the guide portion 96A, and the second section 106B is in contact with the auxiliary guide portion 96B. Hence, position of the movable blade 105 in leftward/rightward direction is fixed, or leftward/rightward movement of the movable blade 105 is restricted.

As described above, since the movable blade 105 has the forward tilting posture, the lower end of the first section 106A contacts a front surface of the rectangular plate section 81A of the first frame 81. On the other hand, the second section 106B does not contact the rectangular plate section 81A, since the second section 106B is positioned frontward of the through-hole 93.

In the following description, the lower end of the first section 106A will be referred to as a contacting portion 109, and a contacting point between the contacting portion 109 and the first frame 81 will be referred to as a third point R (see FIG. 8). The first section 106A contains the contacting portion 109. For explanatory convenience, the third point R is a center in leftward/rightward direction of the contacting portion 109.

Figure 8:
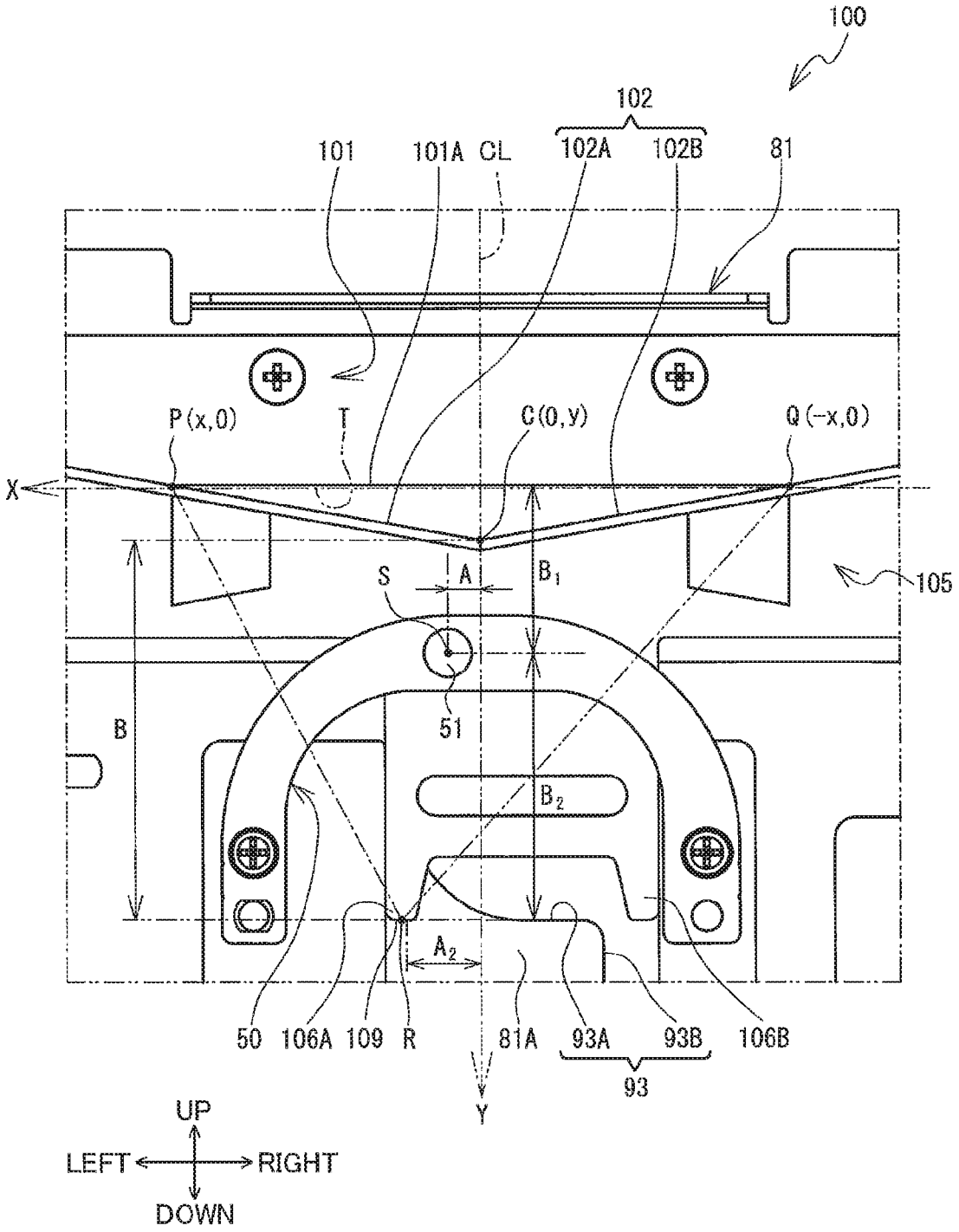
FIG. 8 is an enlarge front view of the cutter unit 100.

Further, an imaginary triangle T is defined by the first point P, the second point Q and the third point R these being triangle vertices (see two dotted chain line in FIG. 8). A line connecting the first point P to the third point R is a first side, a line connecting the second point Q to third point R is a second side, and the line connecting the first point P to second point Q is a third side of the triangle. The imaginary triangle T is a scalene triangle whose first side is shorter than the second side.

As illustrated in FIGS. 4 and 7, a pressure member 50 is positioned frontward of the auxiliary plate 96, and is fixed to the front surface of the rectangular plate section 81A through the auxiliary plate 96 by two male threads 72. The pressure member 50 is a leaf spring having an inverted. U-shape in front view. An upper portion of the pressure member 50 has a pressure contact portion 51. The pressure contact portion 51 is positioned slightly leftward of a center in leftward/rightward direction of the pressure member 50.

The pressure contact portion 51 contacts the lower portion 106 of the movable blade 105 and urges the lower portion 106 rearward. The pressure contact portion 51 has a semi-spherical shape and provides a point contact with the movable blade 105, in the following description, the contacting position of the pressure contact portion 51 with the movable blade 105 will be referred to as pressure contact position S. The pressure contact position S is positioned below and leftward of the of the center C of the second cutting edge portion 102.

As described above, the first point P and the second point Q move in accordance with the movement of the movable blade 105. Here, the pressure contact position. S is positioned within the imaginary triangle T in spite of movement of the first point P and the second point Q. The phrase "the pressure contact position P is positioned within the imaginary triangle T", implies that the pressure contact position P is positioned within the imaginary triangle T as viewed in a conveying direction of the printing medium 7, i.e., frontward/rearward direction. Further, a case where the pressure contact position S is on the first side, or the second side, or the third side of the imaginary triangle T is also within the meaning of "within the imaginary triangle T".

In the following description, a range of contact of the second cutting edge portion 102 with the first cutting edge portion 101A will be referred to as a specific movable range amongst a movable range of the movable blade 105. An upper end of the specific movable range is at a position where the upward/downward position of the center C of the second cutting edge portion 102 becomes coincident with the first cutting edge portion 101A in upward/downward direction. In the specific movable range, the first inclined cutting edge portion 102A contacts the first cutting edge portion 101A at the first point P, and the second inclined cutting edge portion 102B contacts the first cutting edge portion 101A at the second point Q except the upper end of the specific movable range.

The movable blade drive mechanism 130 for moving the movable blade 105 in upward/downward direction will next be described with reference to FIGS. 3 and 6. The movable blade drive mechanism 130 includes a second frame 82 (FIG. 2), a cutter motor 131, an intermediate gear 132, a rotary member 135, and a pin 138, and has an engagement slot 142. The second frame 82 is a metal plate fixed to the first frame 81 (see FIG. 2). The engagement slot 142 is an example of an engagement portion.

The cutter motor 131 is fixed to the second frame 82 by male threads (not illustrated). The cutter motor 131 includes an output shaft 131A extending diagonally downward in rightward direction. A worm 131B is fixed to the output shaft 131A. A support shaft 122 and a support shaft 123 protrude rearward from the second frame 82. The intermediate gear 132 is rotatably supported by the support shaft 122. The intermediate gear 132 includes a large diameter gear 132A and a small diameter gear 132B positioned rearward of the large diameter gear 132A. The large diameter gear 132A is a worm wheel in meshing engagement with the worm 131B.

The rotary member 135 is rotatably supported by the support shaft 123. In other words, the rotary member 135 is rotatably supported by the second frame 82. The rotary member 135 includes a gear portion 135A in meshing engagement with the small diameter gear 132B. Upon rotation of the output shaft 131A of the cutter motor 131, the rotary member 135 rotates through the worm 131B and the intermediate gear 132.

The engagement slot 142 is formed in the lower portion 106 of the movable blade 105, and is positioned frontward of the through-hole 93. The engagement slot 142 is elongated extending in leftward/rightward direction parallel to the first cutting edge portion 101A. The engagement slot 142 is open in frontward/rearward direction.

The pin 138 protrudes rearward from the rotary member 135, and is at an eccentrical position away from the support shaft 123 by a predetermined radial distance. The pin 138 extends through the through-hole 93 and is engaged with the engagement slot 142. The pin 138 is circularly movable about an axis of the support shaft 123 along a circular path whose radius is the predetermined radial distance by the rotation of the rotary member 135. The engagement slot 142 has a sufficient length allowing the pin 138 to move without interference with the engagement slot 142. Further, the through-hole 93 has a sufficient inner size capable of avoiding interference with the pin 138 circularly moving within the through-hole 93.

In accordance with the rotation of the rotary member 135, the pin 138 reciprocally slidingly moved with respect to the engagement slot 142. Hence, the movable blade 105 is moved between a lowermost position (see FIG. 3) which is a lower end of the specific movable range and an uppermost position (see FIG. 5) which is an upper end of the specific movable range. When the movable blade 105 is at the lowermost position, only the pair of extension portions 104 amongst the upper portion 103 contacts the fixed blade 101. When the movable blade 105 is at the uppermost position, the center C of the second cutting edge portion. 102 is positioned above the first cutting edge portion 101A of the of the fixed blade 101.

Next, printing operation performed by the printer 1 will be described with reference to FIGS. 1 and 2. Prior to start of printing operation, the roll 8 is accommodated in the accommodating portion 6, a leading end of the printing medium 7 is positioned in the vicinity of the discharge opening 32, and the front cover 3 is closed.

The conveyer motor (not illustrated) of the printer 1 is driven upon user's input of the print-start instruction through the operating portion 39. Hence, the driving force of the conveyer motor is transmitted to the platen roller 26 through the gear train (not illustrated), and the roller gear 25 to rotate the platen roller 26. Thus, the conveying unit 27 conveys the printing medium 7 toward the cutter unit 100.

At the same time, the print head 29 of the printing unit 21 is driven, so that a character input through the operating portion 39 is printed on the printing medium 7. Here, the character is one of letter, figure, and mark. With such an operation, the printer 1 performs printing on the printing medium 7 and conveying the printing medium 7, and thus, the printing medium 7 is discharged outside through the discharge opening 32. The printing operation is terminated upon stopping operation of the conveyer motor and the print head 29.

Cutting operation performed in the printer 1 will be described with reference to FIGS. 3, 4 and 6. Cutting operation is performed after the printing operation. Upon start of rotation of the cutter motor 131, the driving force of the cutter motor 131 is transmitted to the rotary member 135 through the worm 131B and the intermediate gear 132. Hence, the rotary member 135 rotates in clockwise direction in FIG. 3, so that the pin 138 circularly moves from a lower position toward an upper position. The pin 138 slidingly moves relative to the engagement slot 142, and accordingly, the movable blade 105 is moved upward from its lowermost position while the first section 106A is in contact with the guide portion 96A and the front surface of the rectangular plate section 81A.

When the second cutting edge portion 102 reaches the specific movable range and moves within the specific movable range in accordance with upward movement of the movable blade 105, the movable blade 105 and the fixed blade 101 contact with each other at the two points, i.e., the first point P and the second point Q. The first cutting edge portion 101A of the fixed blade 101 and the second cutting edge portion 102 of the movable blade 105 nip the printing medium 7 therebetween, particularly at the first point P and the second point Q. Hence, a slit (cut line) is formed at each widthwise end portion (in leftward/rightward direction) of the printing medium 7.

In accordance of upward movement of the movable blade 105, the slit becomes longer toward the center line CL. The printing medium 7 is completely cut over its widthwise length when the second cutting edge portion 102 moves past the upper end of the specific movable range.

Thereafter, the movable blade 105 reaches its uppermost position, and at this time, the pin 138 reaches a center portion in leftward/rightward direction of the engagement slot 142. Rotation of the cutter motor 131 continues to circularly moves the pin 138 in the clockwise direction, so that the pin 138 moves downward. As a result, the movable blade 105 is moved from the uppermost position toward the lowermost position. Rotation of the cutter motor 131 is stopped when the movable blade 105 reaches the lowermost position. Hence, the user can take out the cut and printed printing medium 7 discharged through the discharge opening 32.

Next, condition for performing secure cutting operation in the printer 1 will be described with reference to FIGS. 8 through 18. First, pressing forces $F_{1L}$, $F_{1R}$, and $F_2$ are defined in which $F_{1L}$ is a force applied to the first inclined cutting edge portion 102A from the first cutting edge portion 101A at the first point P, $F_{1R}$ is a force applied to the second inclined cutting edge portion 102B from the first cutting edge portion 101A at the second point Q, and $F_2$ is a force applied to the rectangular plate section 81A from the first section 106A at the third point R.

Cutting failure is likely to occur if one of the pressing forces $F_{1L}$ and $F_{1R}$ is insufficient. For example, in a case where the pressing force $F_{1L}$ is excessively lower than the pressing force $F_{1R}$, ($F_{1L}$=0 is inclusive), a portion of the printing medium 7 nipped between the first inclined cutting edge portion 102A and the first cutting edge portion 101A cannot be cut, but is folded downward, and may be entered into a minute gap between the movable blade 105 and the fixed blade 101. Such phenomena is likely to be occur in case of cutting a thin and highly flexible printing medium 7.

In order to avoid this cutting failure, a requirement is made that even pressing force should be applied from the pressure member 50 to the first point P and the second point Q and sufficient pressing forces $F_{1L}$ and $F_{1R}$ should be generated regardless of the upward/downward position of the movable blade 105. Cutting failure can be eliminated by accurate positioning the pressure contact position S which satisfies this requirement.

Note however, that pressing forces $F_{1L}$ and $F_{1R}$ are not necessarily exactly equal to each other. The printing medium 7 may be nipped between the movable blade 105 and the fixed blade 101 and may be securely cut even though the pressing forces $F_{1L}$ and $F_{1R}$ are slightly different from each other. Further, it is necessary to provide a structure where the second section 106B is out of contact with the first frame 81 so that the inclined posture of the movable blade 105 can only be defined by the first point P, the second point Q and the third point R in order to equalize the pressing forces between $F_{1L}$ and $F_{1R}$ regardless of the upward/downward position of the movable blade 105.

For investigation of optimum position of the pressure contact position S, definition of X-Y coordinate, definition of various values, derivation of relational equation as to the various values, and graphical representation as to $F_{1L}$ and $F_{1R}$ will be described in this order. Incidentally, the description in connection with FIGS. 8 through 18 is on a basis of the fact that the movable blade 105 is within the specific movable range.

First, X-Y coordinate will be defined with reference to FIG. 8. X-axis extends in leftward/rightward direction, and leftward direction is defined as a positive direction. Y-axis extends in upward/downward direction, and downward direction is defined as a positive direction. An origin of the X-Y coordinate is an intersection between center line CL and the first cutting edge portion 101A of the fixed blade 101.

In the following description, values of the first point P and the second point Q on X-axis will be represented by x and −x respectively, and value of the center C of the second cutting edge portion 102 on Y-axis will be represented by y. When the movable blade 105 is elevated within the specific movable range, both x and y approach zero. Further, provided that the slope of the first inclined cutting edge portion 102A is represented by α, coordinate of the first point P, the second point Q and the third point R will be represented by (x, 0), (−x, 0), and ($A_2$, αx+B), respectively. Here, $A_2$ is a distance between the center line CL and the third point R in leftward/rightward direction, and B is a distance between the center C and the third point R in upward/downward direction.

Next, definition of various values and relational equation as to the various values wilt be described with reference to FIGS. 8 through 12. The following equation (A) is completed.

$$F_1=F_{1L}+F_{1R} \tag{A}$$

in which F1 is resultant force.

Figure 9:
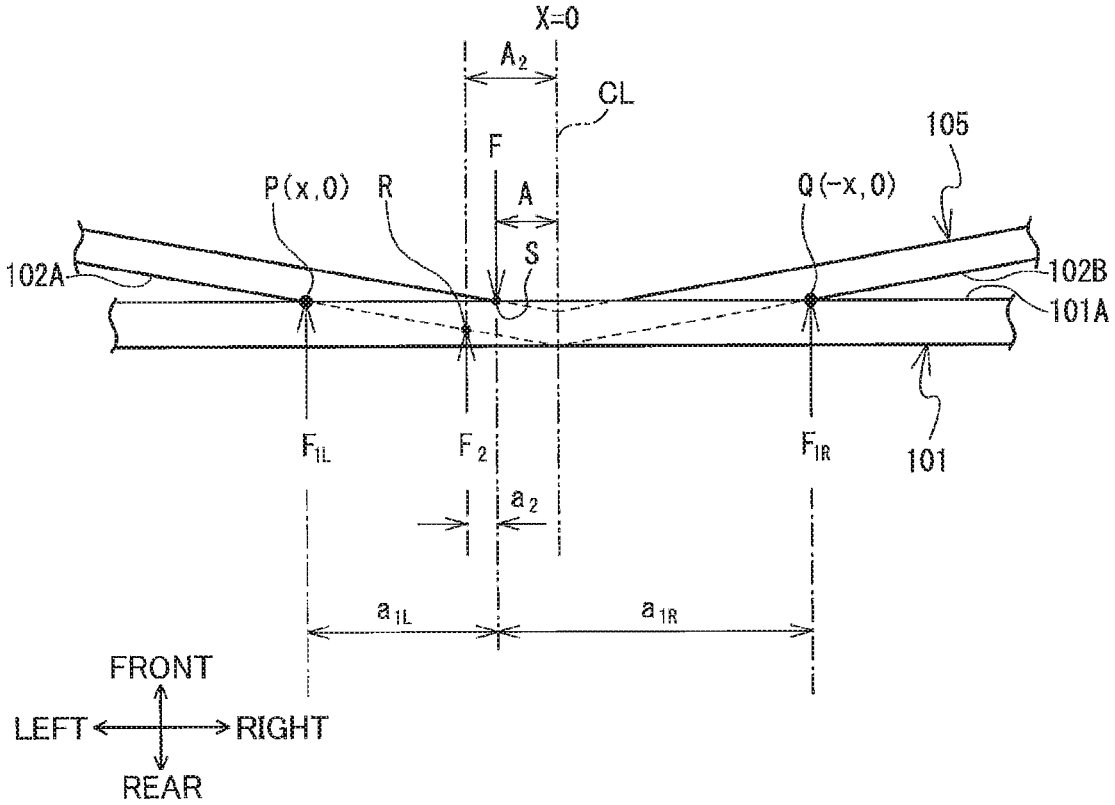
FIG. 9 is a plan view of the fixed blade 101 and the movable blade 105.

As illustrated in FIGS. 8 and 9, distances in leftward/rightward direction will be defined as follows:

$A_2$: a distance between the center line CL and the third point R;

$a_{1L}$: a distance between the first point P and the pressure contact position S;

$a_{1R}$: a distance between the second point Q and the pressure contact position S:

$a_2$: a distance between the third point R and the pressure contact position S

In a plan view, the following equation (B) is completed on a basis of balancing condition of moment centered on the pressure contact position S with respect to the movable blade 105. Further, equations (C), (D), and (E) are completed among $a_{1L}$, $a_{1R}$, $a_2$, A, and $A_2$.

$$a_{1L}\cdot F_{1L}+a_2\cdot F_2=a_{1R}\cdot F_{1R} \tag{B}$$

$$a_{1L}=x-A \tag{C}$$

$$a_{1R}=x+A \tag{D}$$

$$a_2=A_2-A \tag{E}$$

Figure 10:
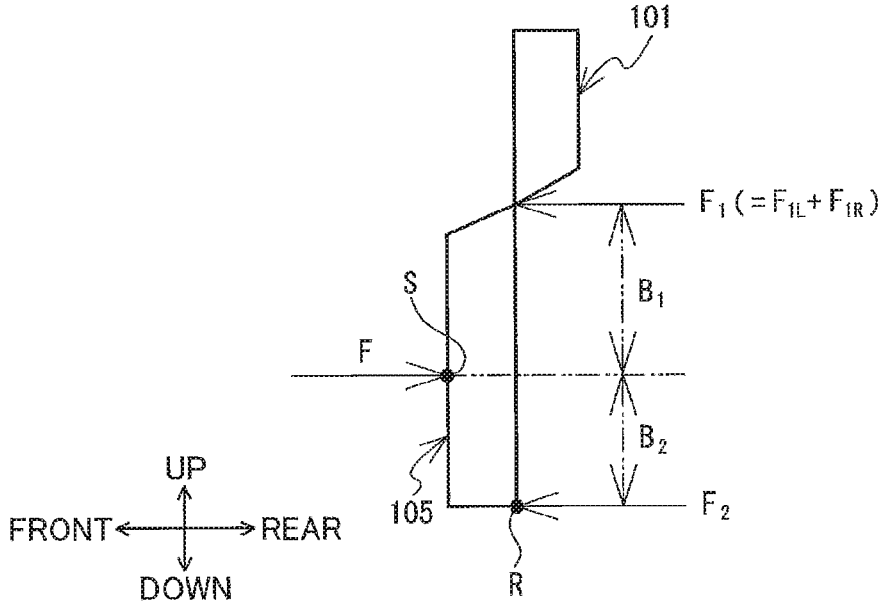
FIG. 10 is an enlarged right-side view of the fixed blade 101 and the movable blade 105.

As illustrated in FIG. 10, distances $B_1$ and $B_2$ in upward/downward direction will be defined as follows:

$B_1$: a distance between the pressure contact position S and a point of action of the resultant force $F_1$ (that is, the first point P and the second point Q);

$B_2$: a distance between the pressure contact position S and the third point R.

Further, force F will be defined as a pressing force of the pressure member 50 against the movable blade 105 at the pressure contact position S. Further, in side view, the following equations (F) and (G) are completed on a basis of equilibrium of forces and equilibrium of moment with respect to the movable blade 105:

$$F=F_1+F_2 \tag{F}$$

$$(B_1+B_2)\cdot F_1=B_2\cdot F \tag{G}$$

Further, relational equation (H) is completed among relationships of B, $B_1$, $B_2$, x, and y.

$$B_2=y+B-B_1=\alpha x+B-B_1 \tag{H}$$

The following two equations are derived from the equations (A), (B), (F) and (G):

$$F_{1L}=\{(a_{1R}\cdot B_2-a_2\cdot B_1)/[(B_1+B_2)\cdot(a_{1L}+a_{1R})]\}\cdot F$$

$$F_{1R}=\{(a_{1L}\cdot B_2+a_2\cdot B_1)/[(B_1+B_2)\cdot(a_{1L}+a_{1R})]\}\cdot F$$

The following equations (1) and (J) are completed on a basis of equations (C), (D), (E), and (H):

$$F_{1L}=\{[(x+A)\cdot(\alpha x+B-B_1)-(A_2-A)\cdot B_1]/[(2x(\alpha x+B)]\}\cdot F \quad (I)$$

$$F_{1R}=\{[(x-A)\cdot(\alpha x+B-B_1)+(A_2-A)\cdot B_1]/[(2x(\alpha x+B)]\}\cdot F \quad (J)$$

Equations (I) and (J) represent $F_{1L}$ and $F_{1R}$ dependent on the x value (i.e., upward/downward position of the movable blade 105). Coordinates of the pressure contact position S (A, $B_1$) are set in a first case where the pressure contact position S is positioned within the imaginary triangle T, and in a second case where the pressure contact position S is outside of the imaginary triangle T and relationship between x and $F_{1L}$ and between x and $F_{1R}$ is graphically represented. As such, determination can be made as to whichever the first case or the second case can provide reduced difference between $F_{1L}$ and $F_{1R}$ in accordance with change in x. Accordingly, prior to graphical representation, it is necessary to specify the relationship between A and B that satisfies a condition that the pressure contact position S can be always positioned within the imaginary triangle T irrespective of shifting of the first point P and the second point Q in accordance with the movement of the movable blade 105. This condition will be referred to as specific condition.

Figure 11:
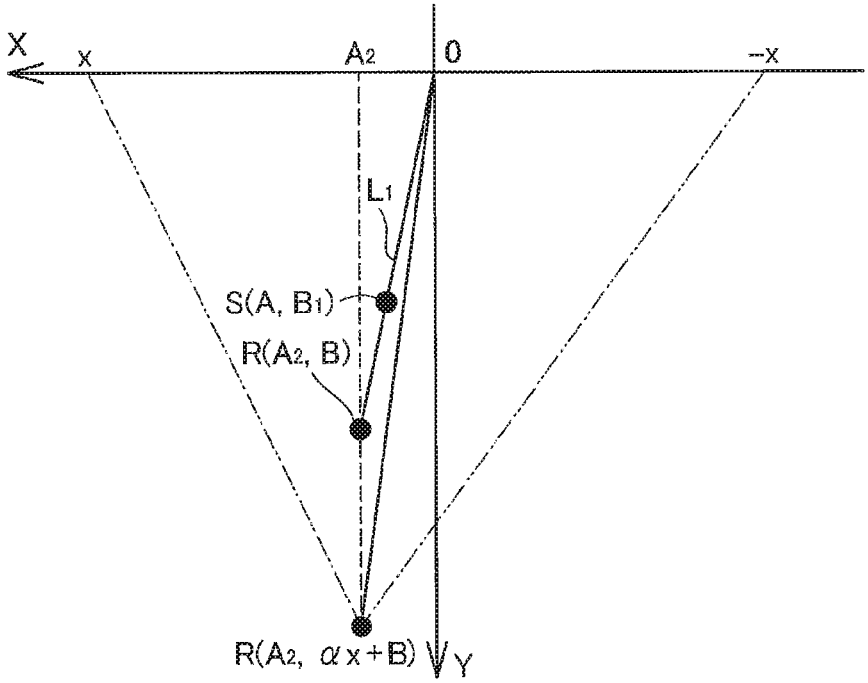
FIG. 11 is a graph for a review of a first specific condition.
Figure 12:
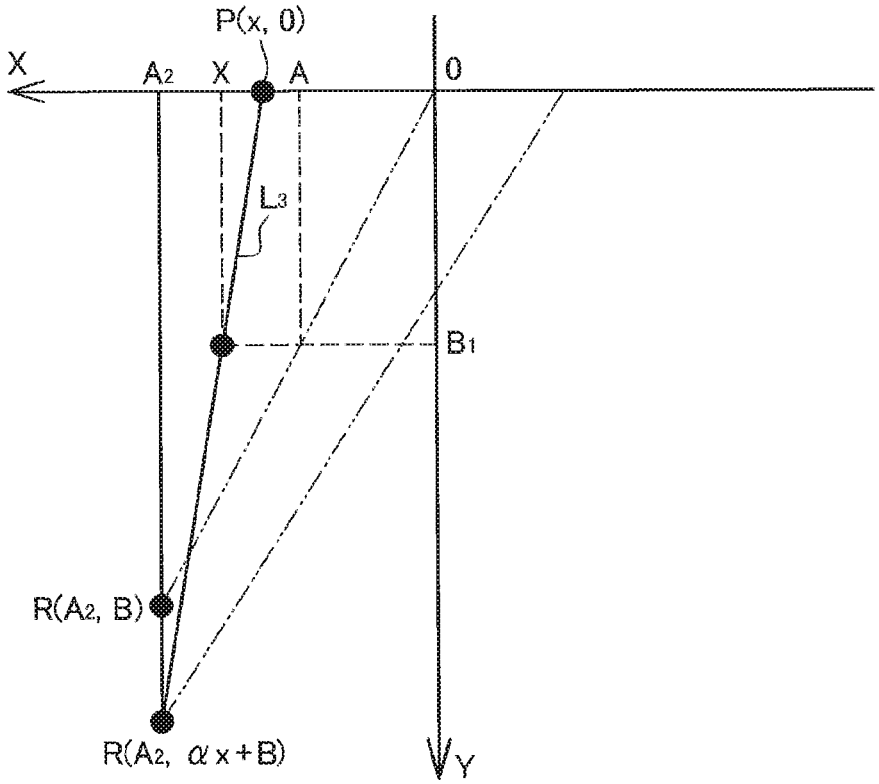
FIG. 12 is a graph for a review of a second specific condition.

The specific condition will be described with reference to FIGS. 11 and 12. In order to complete the condition, a first specific condition and a second specific condition must be completed. The first specific condition is the condition where the pressure contact position S is positioned on a linear line $L_1$ passing through the third point R and the origin when the movable blade 105 is at an upper end of the specific movable range. The second specific condition is the condition where the pressure contact position S is positioned within the imaginary triangle T.

The first specific condition will be described with reference to FIG. 11. When the x=0, the second cutting edge portion 102 is at the upper end of the specific movable range and the coordinate of the third point R is ($A_2$, B). The linear line $L_1$ connecting the origin and the third point R together is represented by "$Y=BX/A_2$". Equation of "$B_1=B\cdot A/A_2$" is completed when the coordinate of the pressure contact position S (A, $B_1$) is on the linear line $L_1$. That is, the following equation (K) is completed:

$$A=A_2\cdot B_1/B \quad (K)$$

The first specific condition is satisfied when the equation (K) is completed.

The second specific condition will be described with reference to FIG. 12. The coordinate of the third point R forming the imaginary triangle T is ($A_2$, $\alpha_x$+B). A linear line $L_3$ connecting the third point R to the first point P is represented by the following equation:

$$Y=(\alpha x+B)\cdot X/(A_2-x)-x\cdot(\alpha x+B)/(A_2-x)$$

When plugging $B_1$ which is Y coordinate of the pressure contact position S for Y, the following equation is completed:

$$B_1=(\alpha x+B)\cdot X/(A_2-x)-x\cdot(\alpha x+B)/(A_2-x)$$

Hence, the following relational equation is completed:

$$X=[B_1\cdot(A_2-x)+x\cdot(\alpha x+B)]/(\alpha x+B)$$

Here, X>A must be completed in order to position the pressure contact position S within the imaginary triangle T. Accordingly, the following equation is completed:

$$[B_1=(A_2-x)+x\cdot(\alpha x+B)]/(\alpha x+B)>A_2\cdot B_1/B$$

Hence, $$x>A_2\cdot B_1/B+(B_1-B)/\alpha$$

Here, because $A_2\cdot B_1/B+(B_1-B)/\alpha<0$, the following in equation (M) is completed:

$$B_1<B^2/(\alpha\cdot A_2+B) \quad (M)$$

The second specific condition is satisfied in a case where the above in equation (M) is satisfied. The specific condition is satisfied in a ease both the equation (K) and in equation (M) are completed.

Positional relationship among the $F_{1L}$, $F_{1R}$ those being graphically represented, the imaginary triangle T, and the pressure contact position S will be described with reference to FIGS. 13 through 18. FIGS. 13A-13C, 15A-15C, and 17A-17C are graphical representations showing a change in shape of the imaginary triangle T in accordance with elevation of the movable blade 105. FIGS. 13A-13C, 15A-15C and 17A-17C show that the first point P and second point Q approach the origin in accordance with upward movement of the movable blade 105. The third point R moves upward in the order of FIG. 13(A), FIG. 13(B), and FIG. 13(C). The same is true with respect to FIGS. 15A-15C and 17A-17C.

Figure 13A:
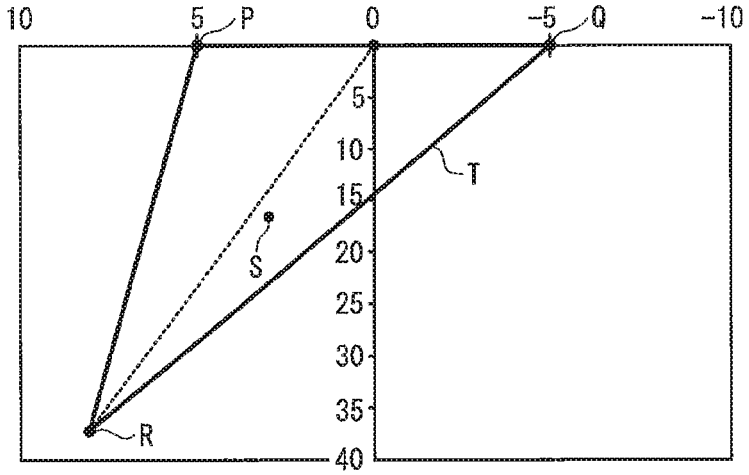
FIG. 13A is a graph for description of a change in positional relationship between a pressure position S and an imaginary triangle T when the first specific condition is not completed, and particularly in a state of a lower position of the movable blade 105.
Figure 13B:
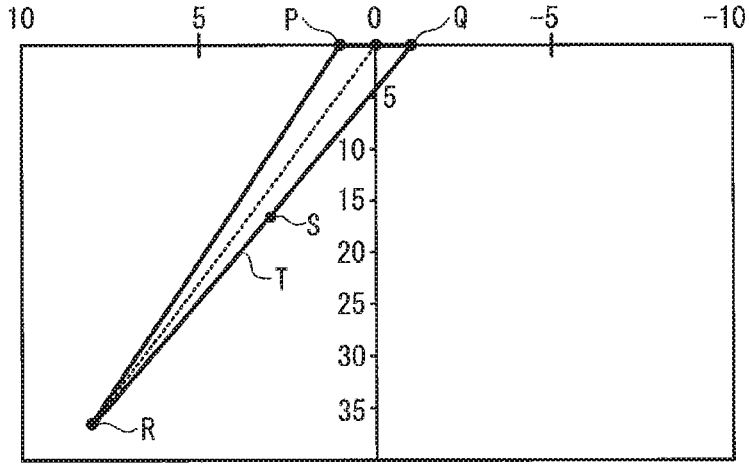
FIG. 13B is a graph the same as the graph of FIG. 13A, and particularly in a state of an intermediate position of the movable blade 105.
Figure 13C:
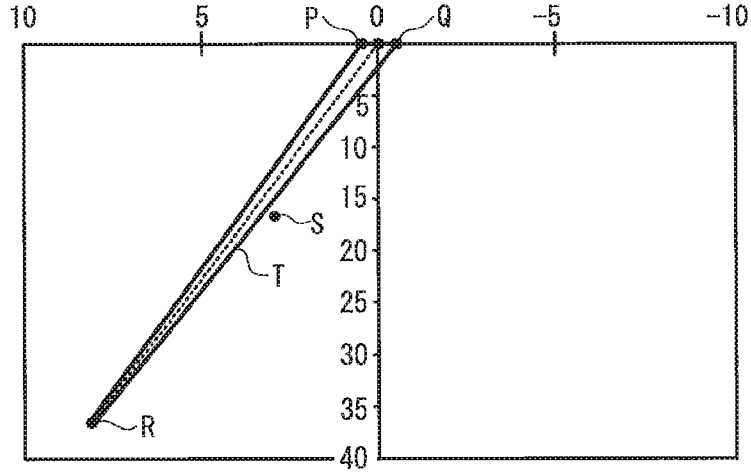
FIG. 13C is a graph the same as the graph of FIG. 13A, and particularly in a state of an upper position of the movable blade 105.
Figure 14:
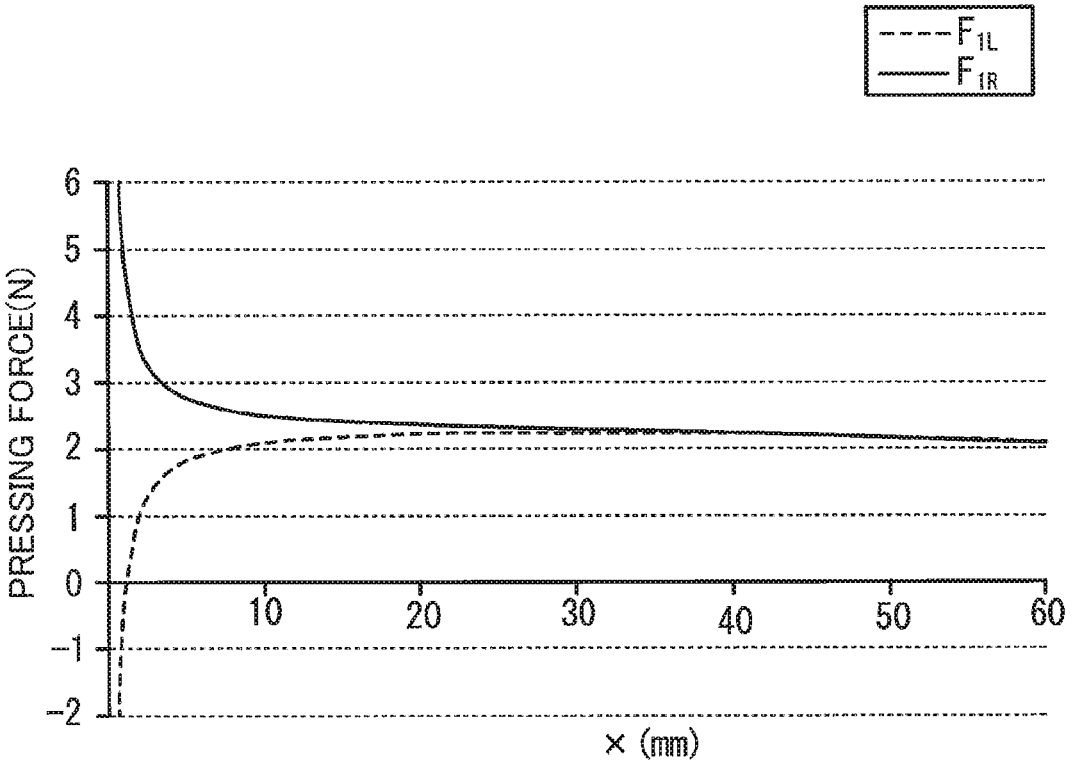
FIG. 14 is a graph for showing changes in $F_{1L}$ and $F_{2R}$ when the first specific condition is not completed.
Figure 15A:
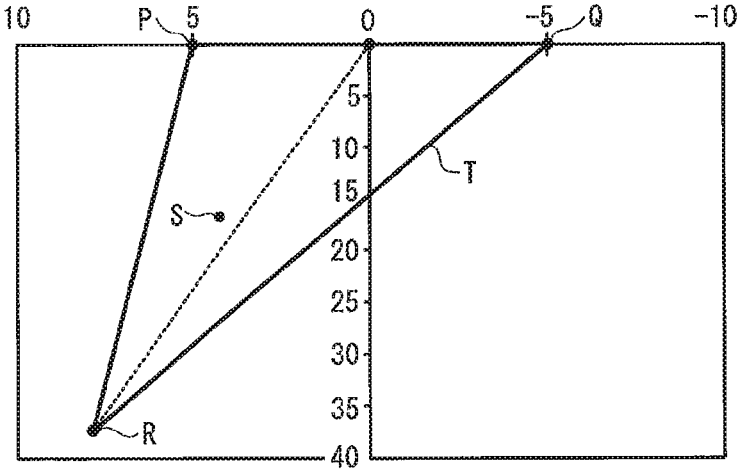
FIG. 15A is a graph for another description of the change in positional relationship between the pressure position S and the imaginary triangle T when the first specific condition is not completed, and particularly in the state of the lower position of the movable blade 105.
Figure 15B:
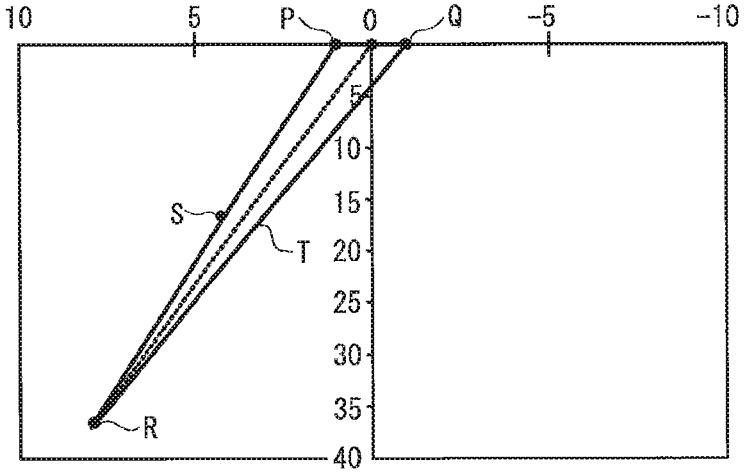
FIG. 15B is a graph the same as the graph of FIG. 15A, and particularly in the state of the intermediate position of the movable blade 105.
Figure 15C:
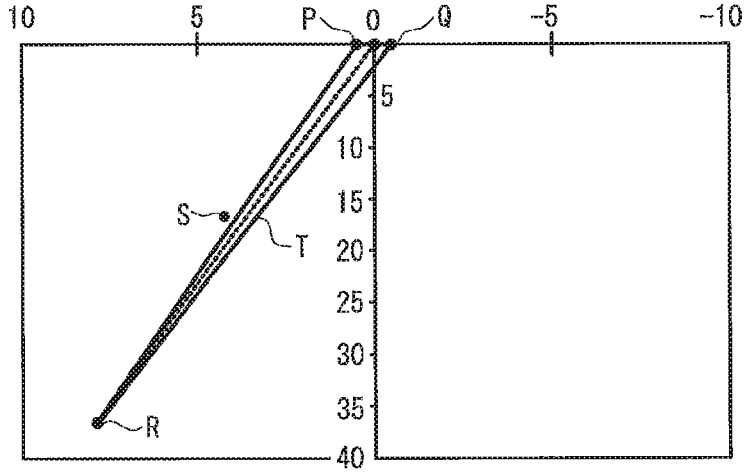
FIG. 15C is a graph the same as the graph of FIG. 15A, and particularly in the state of the upper position of the movable blade 105.
Figure 16:
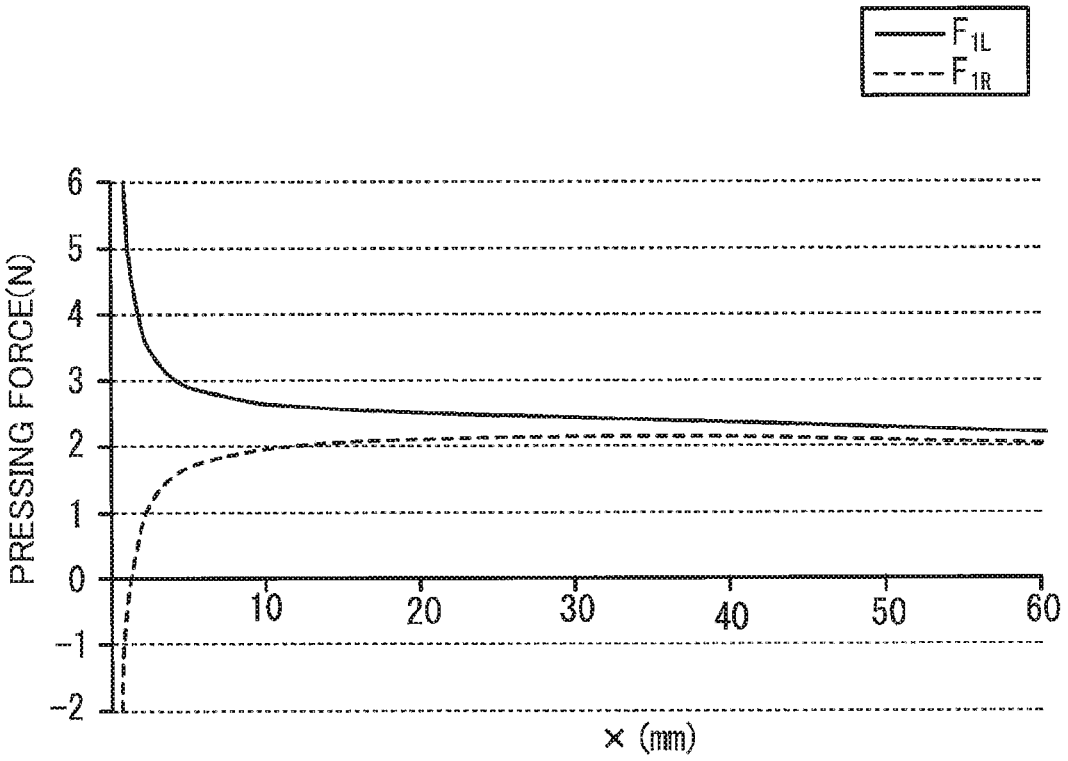
FIG. 16 is a graph different from the graph of FIG. 14 for showing changes in $F_{1L}$ and $F_{2R}$ when the first specific condition is not completed.
Figure 17A:
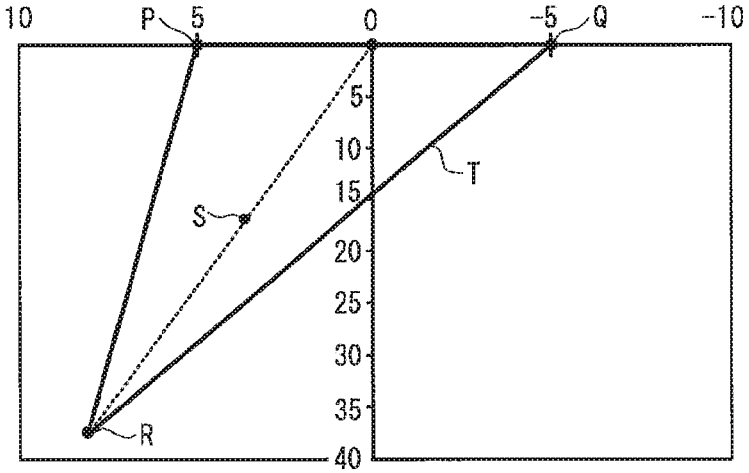
FIG. 17A is a graph for description of the change in positional relationship between the pressure position S and the imaginary triangle T when the first and second specific conditions are completed, and particularly in the state of the lower position of the movable blade 105.
Figure 17B:
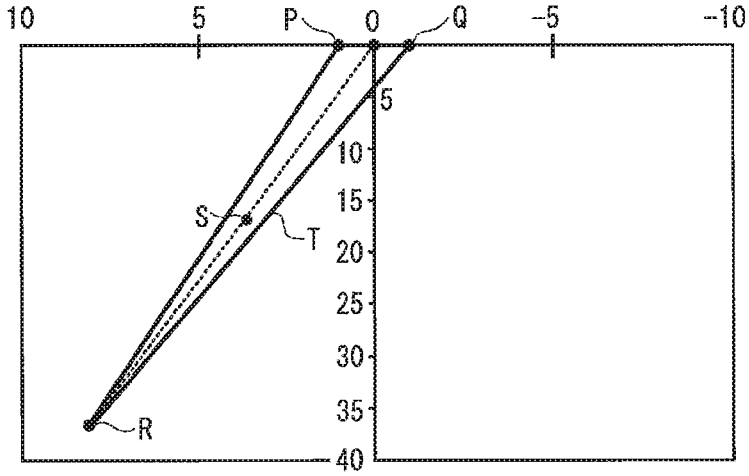
FIG. 17B is a graph the same as the graph of FIG. 17A, and particularly in the state of the intermediate position of the movable blade 105.
Figure 17C:
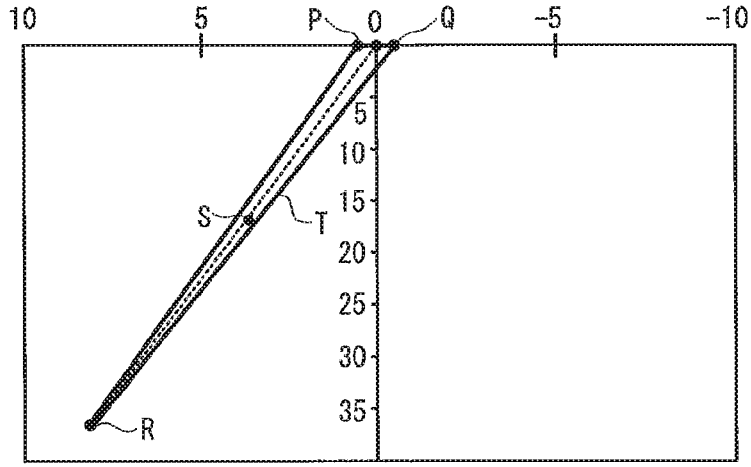
FIG. 17C is a graph the same as the graph of FIG. 17A, and particularly in the state of the upper position of the movable blade 105.
Figure 18:
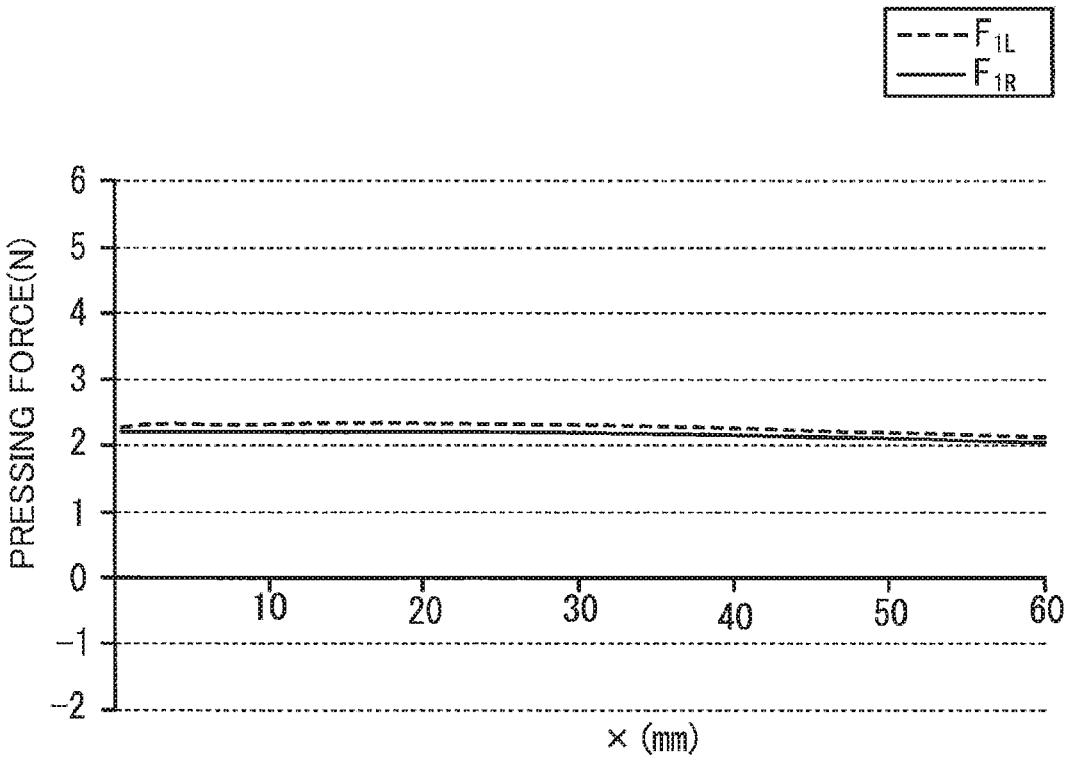
FIG. 18 is a graph for showing changes in $F_{1L}$ and $F_{2R}$ when the first and second specific conditions are completed.

FIGS. 14, 16 and 18 show graphs showing relationship between x which is coordinate of the first point P in X-axis and $F_{1L}$, $F_{1R}$ on a basis of the equations (I) and (J). These graphs show that x approaches the origin in accordance with the upward movement of the movable blade 105. Incidentally, in FIGS. 13, 15 and 17, delineation of the imaginary triangle T in a case where x indicating coordinate of the first point P is greater than 5 is omitted. Further, predetermined values are applied to B and $A_2$, and these values are applied to equations (I), (J), (K), and (M).

FIGS. 13A-13C and 14 are graphs in which $A<A_2\cdot B_1/B$ so that the equation (K) is not completed but the equation (M) is completed. As shown in FIGS. 13A through 13C, the pressure contact position S is positioned outside of the imaginary triangle T and is positioned rightward of the imaginary triangle T, when the first point P and the second point Q approach the origin in accordance with upward movement of the movable blade 105. And, as shown in FIG. 14, difference between $F_{1L}$ and $F_{1R}$ becomes excessively larger as the first point P and the second point Q approach the origin. That is, cutting failure is likely to occur.

FIGS. 15A-15C and 16 are graphs in which $A>A_2\cdot B_1/B$ so that the equation (K) is not completed but the equation (M) is completed. As shown in FIGS. 15A through 15C, the pressure contact position S is positioned outside of the imaginary triangle T and is positioned leftward of the imaginary triangle T, when the first point P and the second point Q approach the origin in accordance with upward movement of the movable blade 105. And, as shown in FIG. 16, difference between $F_{1L}$ and $F_{1R}$ becomes excessively larger as the first point P and the second point Q approach the origin.

As described above, the second cutting edge portion 102 of the movable blade 105 and the first cutting edge portion 101A of the fixed blade 101 contact with each other at the first point P and the second point Q. The first point P and the second point Q approach the origin in accordance with upward movement of the movable blade 105.

FIG. 13C shows that when a distance between the first point P and the second point Q becomes not more than a predetermined distance W2 in accordance with the movement of the first point P and second point Q toward the origin, the pressure contact position S is positioned outside of and rightward of the imaginary triangle T. FIG. 15C shows that when the distance between the first point P and the second point Q becomes not more than a predetermined distance W2 in accordance with the movement of the first point P and second point Q toward the origin, the pressure contact position S is positioned outside of and leftward of the imaginary triangle T.

This offers a logical explanation that the pressing force applying to the first point P is largely different from the pressing force applying to the second point Q when the pressure contact position S is positioned outside the imaginary triangle T, and hence, cutting failure is likely to occur.

However, as a result of real device verification, cutting failure did not occur even if the pressure contact position S is positioned outside of the imaginary triangle T in a case where the distance between the first point P and the second point Q is not more than 2 mm.

FIGS. 17A-17C and 18 are graphs in which the equations (K) and (M) are both satisfied, and the specific condition is completed. As shown in FIGS. 17A through 17C, the pressure contact position S is positioned within the imaginary triangle T, when the movable blade 105 is moved upward. And, as shown in FIG. 18, difference between $F_{1L}$ and $F_{1R}$ is not prominent as the first point P and the second point Q approach the origin. Accordingly, conclusion is made that the cutter unit 100 can perform secure cutting operation with respect to the thin and soft printing medium 7 as tong as the specific condition is completed.

In view of the foregoing, most preferably, the pressure contact position. S is always positioned within the imaginary triangle T irrespective of movement of the first point P and the second point Q in accordance with the movement of the movable blade 105. However, this is not limiting. That is, desirable cutting is also performable as long as the pressure contact position S is positioned within the imaginary triangle T in accordance with a partial movement of the first point P and second point Q ranging from the farthest distance therebetween to the closest distance of 2 mm amongst the entre movable range thereof. This is also within the scope of the disclosure.

Incidentally, the pressure contact position S is positioned outside of the imaginary triangle T to increase the difference between $F_{1L}$ and the $F_{1R}$ in a case where the equation (M) is not completed regardless of completion of equation (K). Graphical showing in such a case is omitted since graphs of FIGS. 13A through 16 are also applicable in this case.

As described above, the movable blade 105 has the upper end forming the V shaped second cutting edge portion 102. Further, the movable blade 105 has the lower end portion forming the contacting portion 109 in contact with the rectangular plate section 81A of the first frame 81. The pressure member 50 presses against the movable blade 105 in the rearward direction toward the fixed blade 101 and the rectangular plate section 81A of the first frame 81. The pressure contact position S is positioned within the imaginary triangle T when the movable blade 105 is moved within the specific movable range.

Pressing force from the pressure member 50 is always applied to the first point P, the second point Q and the third point R by positioning the pressure contact position S within the imaginary triangle T. That is, the pressing force from the pressure member 50 urges the second cutting edge portion 102 to press against the first cutting edge portion 101A of the fixed blade 101 at the first point P and the second point Q. Since the first point P and the second point Q are cutting points for cutting the printing medium 7 as the cut item, the cutter unit 100 can securely cut the cut item that is likely to incur cutting failure such as a thin and highly flexible printing medium 7.

The pressure contact position S is positioned within the imaginary triangle T in spite of movement of the first point P and second point Q in accordance with movement of the movable blade 105. Therefore, the second cutting edge portion 102 is always in pressure contact with the first cutting edge portion 101A. Accordingly, the printing medium 7 can be securely cut by the cooperation of the movable blade 105 and the fixed blade 101.

The first side and the second side of the imaginary triangle T have lengths different from each other. The pressing force from the pressure member 50 can be securely applied to the first point P, the second point Q, and the third point R irrespective of the third point R as being an apex of the first side and the second side of the scalene triangle.

The movable blade 105 includes the lower portion 106 including the first section 106A and the second section 106B arrayed with the first section 106A in leftward/rightward direction that is the extending direction of the first cutting edge portion 101A. The first section 106A includes the contacting portion 109 in contact with the first frame 81, whereas the second section 1068 is out of contact with the first frame 81. The first section 106A can be securely contacted with the rectangular plate section 81A of the first frame 81 because the second section 106B does not contact the first frame 81. Accordingly, the contacting point between the first section 106A and the first frame 81 can be the third point R.

The pressure member 50 includes the pressure contact portion 51, and the pressure contact portion 51 has a rounded shape. Contacting area of the pressure contact portion 51 with respect to the movable blade 105 can be reduced because of the rounded shape of the pressure contact portion 51. Accordingly, frictional resistance generated between the pressure member 50 and the movable blade 105 can be lowered. Hence, smooth movement in upward/downward direction of the movable blade 105 can result.

The pressure member 50 is the leaf spring. Hence, the cutter unit 100 can be simplified in structure.

The rotary member 135 is rotatably supported by the second frame 82 which is the different member from the first frame 81. The pin 138 is at the eccentric position offset, by the radial distance, from the support shaft 123 which is the rotation axis of the rotary member 135. The pin 138 is engaged with the engagement slot 142, and extends through the through-hole 93. Rotation of the cutter motor 131 rotates the rotary member 135 so that pin 138 is slidingly moved relative to the engagement slot 142 to move the movable blade 105 in upward/downward direction. Since the pin 138 provided on the rotary member 135 is directly engaged with the engagement slot 142 of the movable blade 105, the movable blade drive mechanism 130 of the cutter unit 100 can be simplified in comparison with a case where the pin 138 is indirectly connected to the movable blade 105 through an intermediary component.

Various modifications are conceivable. For example, the first section 106A may have a triangular shape instead of the rectangular shape in front view, such that an apex is at the lowermost end of the triangle. In this case the lowermost end of the first section 106A functions as the contacting portion 109, and the position of the contacting portion 109 is coincident with the position of the third point R in front view.

The movable blade 105 may be movable in frontward/rearward direction instead of upward/downward direction.

In this case, the first cutting edge portion 101A is formed at a rear end of the fixed blade 101, and the second cutting edge portion 102 is formed at a front end of the movable blade 105.

The pressure contact portion 51 may have a partially cylindrical shape extending in leftward/rightward direction and protruding rearward. In this case, the pressure contact portion 51 is in line-contact with the movable blade 105, and the pressure contact position S may be any arbitrary point on the contacting line. At least one arbitrary point should be positioned within the imaginary triangle T. Any resiliently urging member is available as the pressure member 50 instead of the leaf spring. Further, a groove may be available instead of the through-hole (the engagement slot 142) as the engagement portion.

Further, the cutter motor 131 may be reversely rotatable when the movable blade 105 reaches the uppermost position. In this case, the pin 138 is slidingly moved while circularly moving from its uppermost position toward the lowermost position to move the movable blade 105 from the uppermost position to the lowermost position. The printer 1 may be available as a thick and highly rigid printing medium. The user sets the selected printing medium in the accommodating portion 6.

While the description has been made in detail with reference to the specific embodiment, it would be apparent to those skilled in the art that various changes and modifications may be made without departing from the scope of the disclosure.

What is claimed is:

1. A cutter unit comprising:

a first frame;

a fixed blade fixed to the first frame and having a flat plate shape, the fixed blade having a first cutting edge portion extending linearly;

a movable blade movable in a moving direction, and having a flat plate shape, the movable blade having one end portion and another end portion in the moving direction;

the one end portion having one end in the moving direction formed with a second cutting edge portion having V-shape and configured to cut a cut item in cooperation with the first cutting edge portion, the second cutting edge portion and the first cutting edge portion contacting with each other at a first point and a second point; and the another end portion having a contacting portion in contact with the first frame at a third point such that part of the another end portion other than the contacting portion is out of contact with the first frame, the first point, the second point and the third point defining an imaginary triangle such that each of the first point, the second point and the third point is an apex of the imaginary triangle;

a movable blade drive mechanism configured to move the movable blade in the moving direction; and a pressure member pressing the movable blade at a pressure contact position so that the movable blade presses against the fixed blade in a pressing direction crossing the moving direction and directing from the pressure member toward the fixed blade and the first frame, the pressure contact position being positioned substantially within the imaginary triangle.

2. The cutter unit according to claim 1, wherein the pressure contact position is positioned definitely within the imaginary triangle in spite of shifting of the first point and the second point in accordance with the movement of the movable blade in the moving direction.

3. The cutter unit according to claim 1, wherein the imaginary triangle has a first side connecting the first point to the third point, and a second side connecting the second point to the third point, the first side and the second side having lengths different from each other.

4. The cutter unit according to claim 1, wherein the another end portion has a first end portion and a second end portion in an extending direction of the first cutting edge portion, the first end portion being provided with a first section, the second end portion being provided with a second section that is arrayed with the first section in the extending direction, wherein the first section contains the contacting portion, and wherein the second section is out of contact with the first frame.

5. The cutter unit according to claim 1, wherein the pressure member comprises a pressure contact portion contacting the movable blade at the pressure contact position, the pressure contact portion having a rounded shape.

6. The cutter unit according to claim 1, wherein the pressure member is a leaf spring.

7. The cutter unit according to claim 1, wherein the first frame is formed with a through-hole, and wherein the movable blade drive mechanism comprises:

an engagement portion formed in the movable blade and extending in an extending direction of the first cutting edge portion;

a second frame different from the first frame;

a rotary member rotatably supported by the second frame;

a pin protruding from the rotary member at a position eccentric from a rotation axis of the rotary member, the pin extending throughout the through-hole and slidably engaged with the engagement portion; and a cutter motor configured to rotate the rotary member, rotation of the cutter motor causing rotation of the rotary member so that the pin slidingly moves relative to the engagement portion, whereby the movable blade moves in the moving direction.

8. A printer comprising:

the cutter unit according to claim 1;

a printing unit configured to perform printing on a printing medium as the cut item; and a conveying unit configured to convey the printing medium on which an image is formed by the printing unit toward the cutter unit.

* * * * *